US006991204B2

(12) United States Patent
Ay

(10) Patent No.: US 6,991,204 B2
(45) Date of Patent: Jan. 31, 2006

(54) RECESSED HANGING APPARATUS

(76) Inventor: Charles Ay, 19481 Jasper Hill Rd., Trabuco Canyon, CA (US) 92679

( * ) Notice: Subject to any disclaimer, the term of this patent is extended or adjusted under 35 U.S.C. 154(b) by 0 days.

(21) Appl. No.: 10/604,428

(22) Filed: Jul. 21, 2003

(65) Prior Publication Data

US 2004/0104325 A1 Jun. 3, 2004

(51) Int. Cl.
*F16B 45/00* (2006.01)

(52) U.S. Cl. ..... 248/308; 248/304; 248/215; 248/914; 211/100; 211/171

(58) Field of Classification Search ..... 248/304–308, 248/201, 215, 339, 291.1, 294.1, 219.4; 211/1.3, 211/100, 171
See application file for complete search history.

(56) References Cited

U.S. PATENT DOCUMENTS

| | | | | | |
|---|---|---|---|---|---|
| 0,561,664 | A | | 6/1896 | Hollister | |
| 1,342,626 | A | | 6/1920 | Frank | |
| 2,071,257 | A | * | 2/1937 | Hansen | 248/294.1 |
| 2,484,535 | A | * | 10/1949 | Stader | 211/99 |
| 2,706,049 | A | * | 4/1955 | Andrews | 224/482 |
| 3,385,547 | A | * | 5/1968 | West | 248/308 |
| 3,746,294 | A | | 7/1973 | Johnston | |
| 3,785,604 | A | | 1/1974 | Steck | |
| 3,941,250 | A | * | 3/1976 | Ott | 211/1.3 |
| 4,051,953 | A | * | 10/1977 | Shoaf | 211/119.1 |
| 4,113,057 | A | | 9/1978 | Bessinger | |
| D259,228 | S | * | 5/1981 | Fabian | D6/324 |
| 4,409,907 | A | | 10/1983 | Norton | |
| 4,651,961 | A | * | 3/1987 | Melvin | 248/291.1 |
| 4,744,537 | A | | 5/1988 | Buckley | |
| 4,830,143 | A | | 5/1989 | Fisher | |
| 5,263,675 | A | * | 11/1993 | Roberts et al. | 248/219.4 |
| 5,301,911 | A | | 4/1994 | Beauchemin | |
| 5,310,151 | A | | 5/1994 | Engel | |
| 5,335,889 | A | * | 8/1994 | Hopkins et al. | 248/231.81 |
| 5,409,083 | A | | 4/1995 | Thompson | |
| 5,427,344 | A | | 6/1995 | Beauchemin | |
| 5,562,180 | A | | 10/1996 | Herzog | |
| 5,586,674 | A | * | 12/1996 | Nachbauer | 206/315.4 |
| D385,480 | S | * | 10/1997 | Mayo | D8/372 |
| 5,727,760 | A | | 3/1998 | Wytovak | |
| 6,065,722 | A | | 5/2000 | LeVasseur | |
| 6,095,469 | A | | 8/2000 | Von Alman | |
| 6,109,579 | A | * | 8/2000 | Huang | 248/294.1 |
| 6,196,511 | B1 | | 3/2001 | Beauchemin | |
| 6,202,964 | B1 | * | 3/2001 | Thornhill | 248/219.4 |
| D440,147 | S | * | 4/2001 | Rimback | D8/363 |
| 6,289,989 | B1 | * | 9/2001 | Mueller et al. | 166/311 |
| 6,397,435 | B1 | | 6/2002 | Gosselet | |
| 6,457,838 | B1 | * | 10/2002 | Dugmore et al. | 362/106 |
| 6,478,272 | B1 | | 11/2002 | McKinsey | |

* cited by examiner

*Primary Examiner*—Amy J. Sterling
(74) *Attorney, Agent, or Firm*—Rosenberg, Klein & Lee

(57) ABSTRACT

A hanging apparatus includes a body containing a rotating hanging member that may be recessed inside the body when not being used and easily rotated out from the body at an angle when needed to hang an item. The use of a hanging member that can be recessed provides for a hanging system that is more compact for storage and packaging, and less unsightly when not being used to hang an item. The hanging apparatus may be temporarily secured to an object, such as a tree trunk when used outdoors, with a belt that passes through a channel in the body. Alternatively, the hanging apparatus may be attached to an object or structure through use of conventional attachment means such as a screw, nail, or adhesive. The hanging apparatus may also be built directly into a structure such as a wall.

8 Claims, 7 Drawing Sheets

FIG. 13
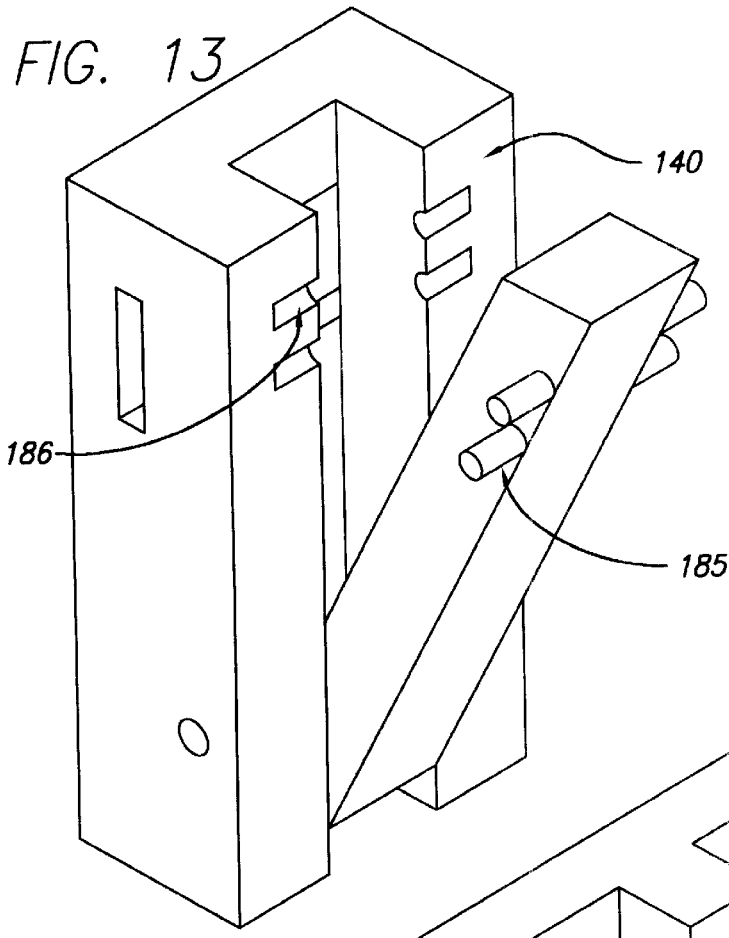
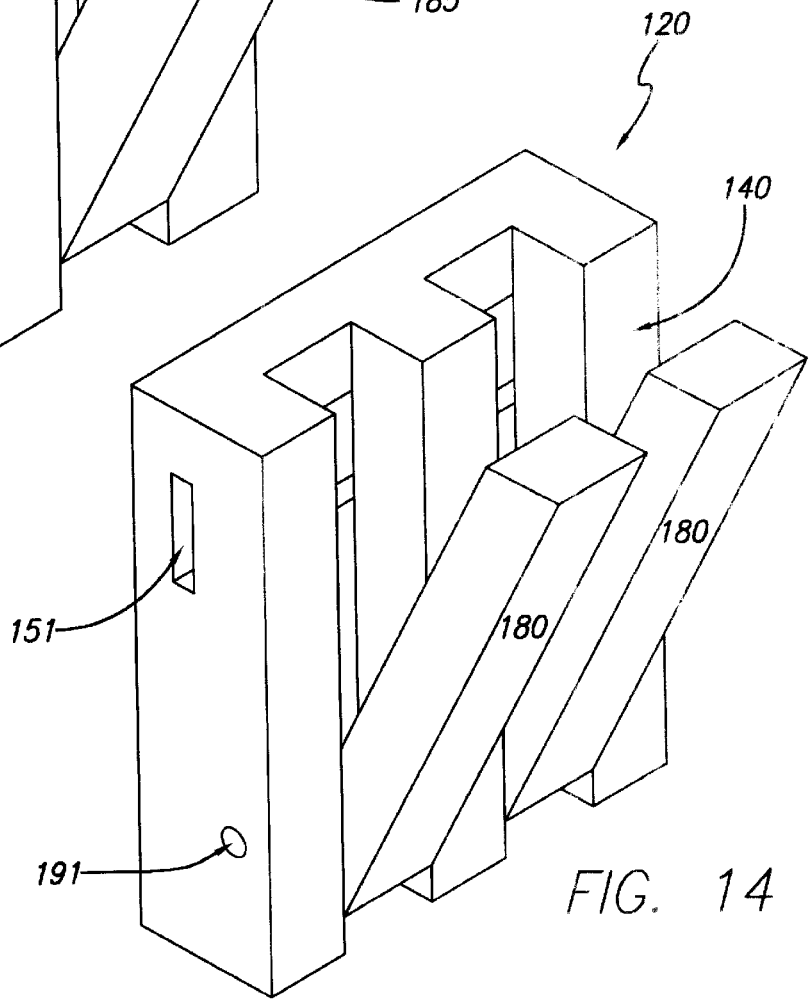
FIG. 14

RECESSED HANGING APPARATUS

BACKGROUND OF THE INVENTION

This invention relates generally to hanging devices, and more particularly to a hanging apparatus which includes a hanging member that is recessed into a body when not in use, and which can be rotated about an axis to extend out of the body so that an item may be hung from it.

BRIEF SUMMARY OF THE INVENTION

An object of the present invention is to provide a hanging apparatus which can be easily and quickly attached to an object such as, for example, a tree trunk.

It is another object of this invention to provide a hanging apparatus which is capable of being stored and transported in a configuration that is unobtrusive and compact when not in use.

It is another object of the invention to provide a hanging apparatus of such a configuration that at least a portion of the weight of a hanging item may be used to assist in supporting the object itself.

The above noted objects and other objects of the invention may be accomplished in a preferred embodiment of the invention that includes a belt of sufficient length to encircle an object, such as a tree trunk, and at least one hanging apparatus attached to said belt, said at least one hanging apparatus having a body with a recess that contains a rotatable hanging member.

BRIEF DESCRIPTION OF THE SEVERAL VIEWS OF THE DRAWINGS

FIG. 13 is a perspective view of a third embodiment of hanging apparatus 120 that has a hanging member 180 with fingers 185.

FIG. 14 is a perspective view of a fourth embodiment of hanging apparatus 120 with a plurality of hanging members 180.

DETAILED DESCRIPTION OF THE INVENTION

Figure 1:
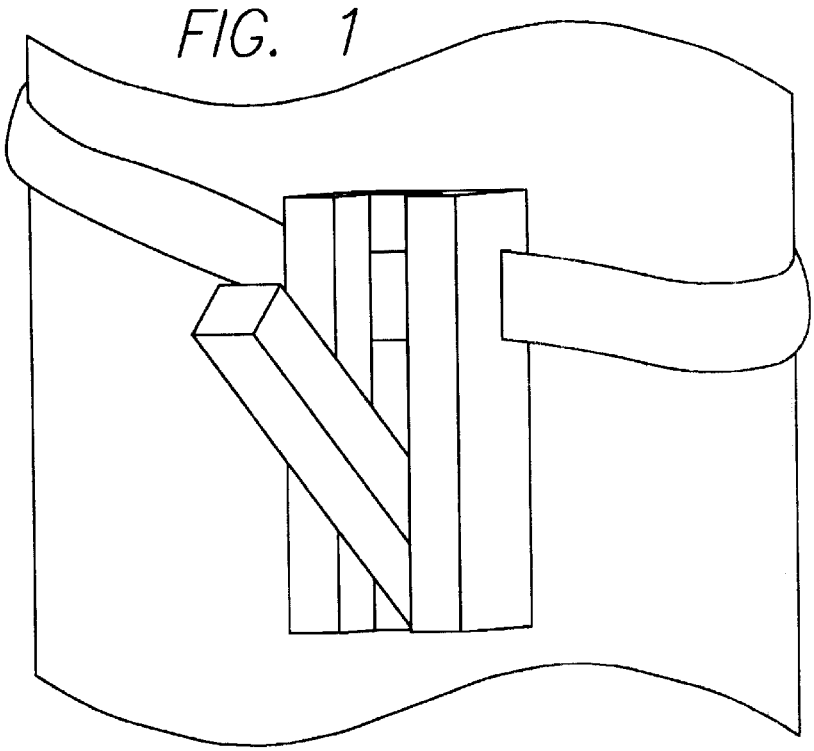
FIG. 1 is a perspective view of a first embodiment of the hanging system in accordance with the present invention shown installed on the trunk of a tree.
Figure 2:
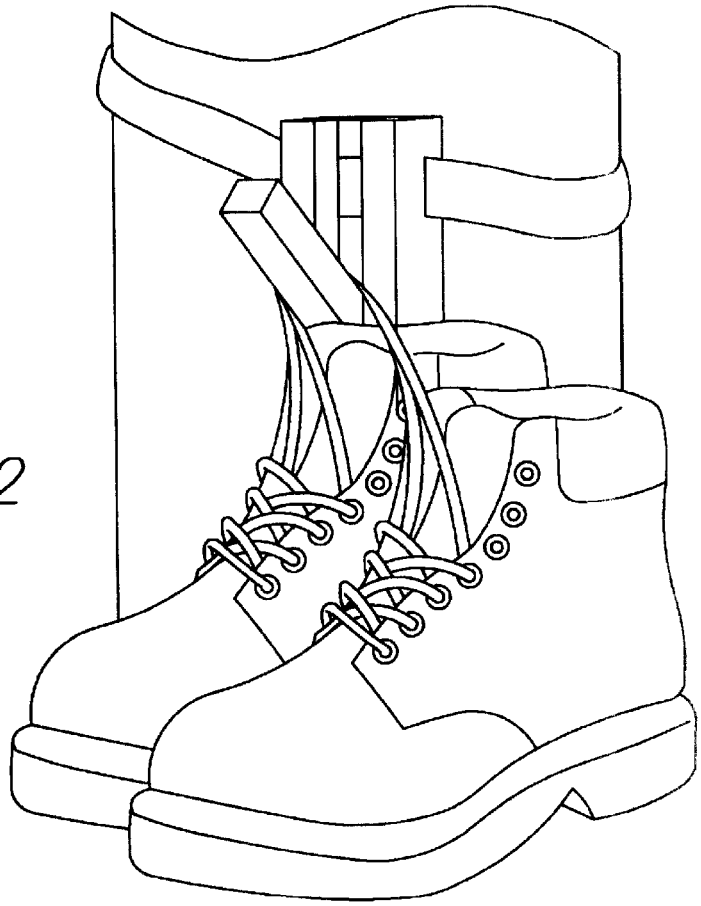
FIG. 2 is a perspective view of the hanging system of FIG. 1 shown with an item hanging.
Figure 10:
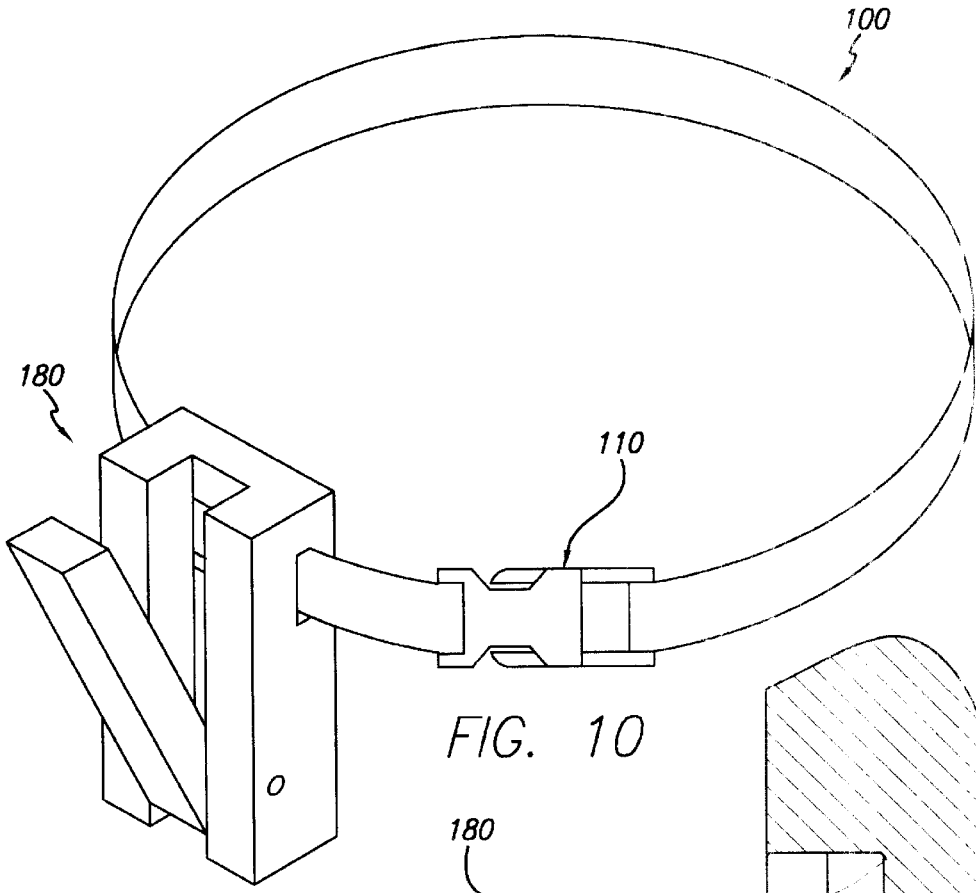
FIG. 10 is a perspective view of a hanging system of the first embodiment showing a hanging apparatus 120 slidably attached to support member 100.

In the following discussion, a preferred embodiment of the hanging system will be described as being installed on the trunk of a tree, but it should be understood that it can be installed on other types of objects. Referring now to FIG. 1, the illustrated hanging system supports various articles from a tree trunk and is particularly useful for campers and hikers. FIG. 2 illustrates an embodiment of the invention being used to hang a pair of boots. FIG. 10 shows a support member 100 in the form of a belt preferably made of nylon material that is used to encircle an object, such as the tree trunk, and secure a hanging apparatus 120 tightly against the object. Hanging apparatus 120 is preferably attached to support member 100 so that it can slide along support member 100 when not pressed against an object by tension in support member 100. Tension is maintained in support member 100 by buckle 110.

Figure 3:
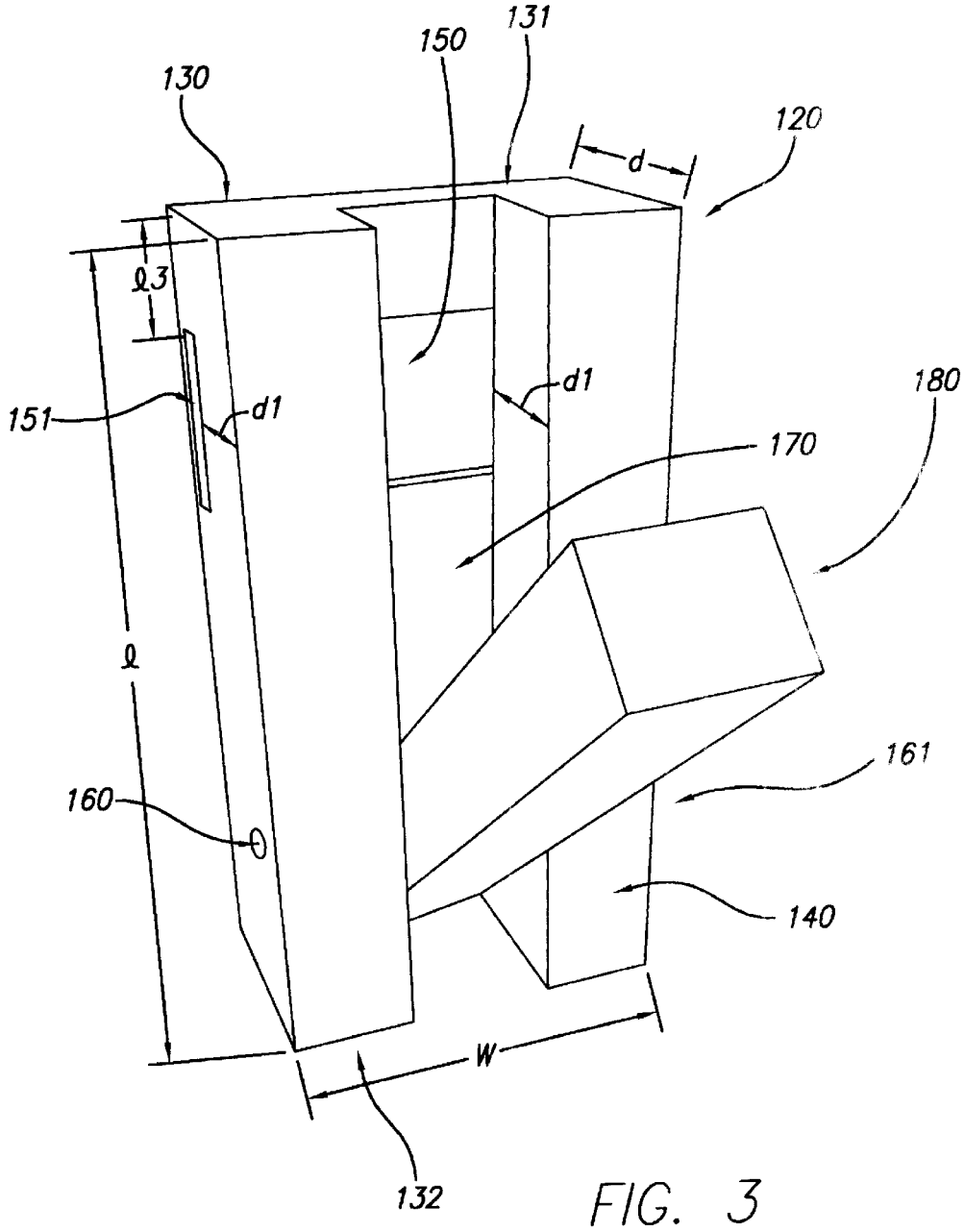
FIG. 3 is a perspective view of the hanging apparatus 120 of the first embodiment hanging system with hanging member 180 extended for use in hanging an item.

Referring now to FIG. 3, a structural means used to accomplish a hanging function is shown in further detail. In particular, hanging apparatus 120 in a preferred embodiment has a body that is a substantially rectangular cube having a length l, width w, and depth d. Hanging apparatus 120 has six outer surfaces, including a major rear surface 130 and oppositely facing major front surface 140 that extend in a substantially parallel fashion lengthwise between proximate end 131 and distal end 132.

Hanging apparatus 120 contains a channel 150 located a distance 13 from proximate end 131. Preferably channel 150 is located at a depth d1 from major front surface 140 and extends widthwise through the interior of hanging apparatus 120 between an opening 151 in minor surface 160 to an opening 152 in opposite facing and substantially parallel minor surface 161. Channel 150 is of a size, shape and volume sufficient to accommodate the passage through it of support member 100, such that major rear surface 130 may be secured firmly against an object by the tension in support member 100 when it is wrapped around such object and secured in place by buckle 110. An opening may be present in level floor 171 of recess 170, described in further detail below, where channel 150 passes underneath recess 170.

Figure 4:
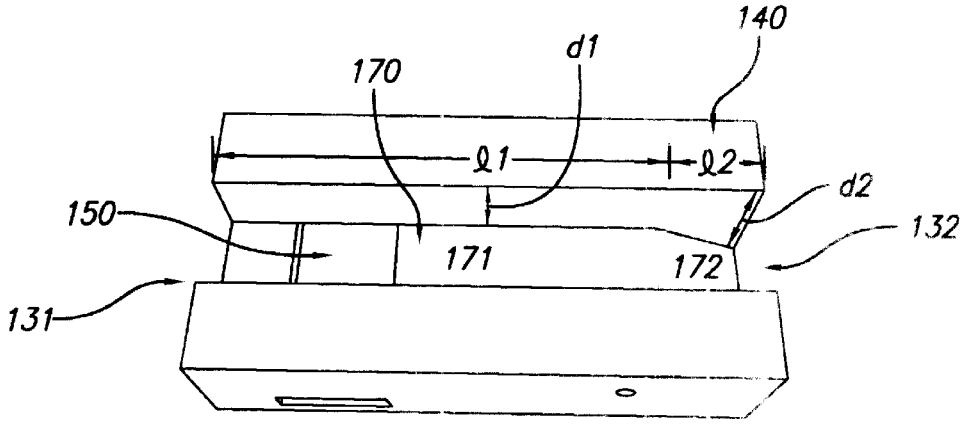
FIG. 4 is a perspective view of hanging apparatus 120 of the first embodiment hanging system with hanging member 180 removed so as to show level floor 171 and sloping floor 172.
Figure 5:
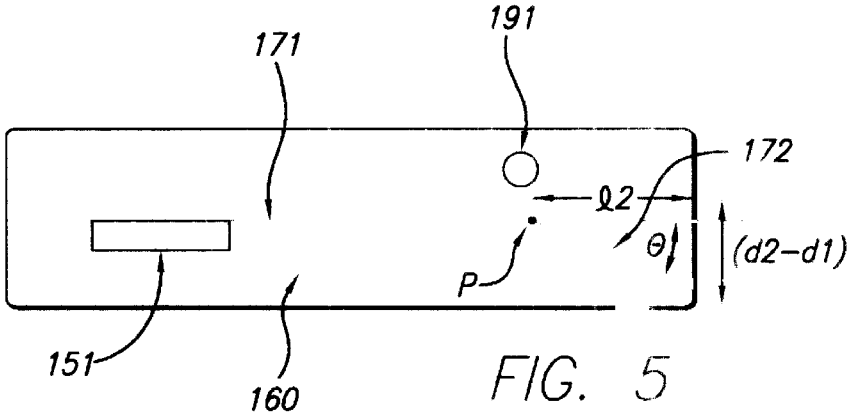
FIG. 5 is a side cross-section view of a hanging apparatus 120 as shown in FIG. 4 to illustrate the angle between sloping floor 172 and level floor 171.

Referring now to FIG. 4., hanging apparatus 120 contains recess 170. Recess 170 runs through hanging apparatus 120 forming a lengthwise opening in major front surface 140 between distal end 132 and proximate end 131. Recess 170 is preferably substantially perpendicular in direction to channel 150. Recess 170 is of width w' that is less than width w of hanging apparatus 120. Recess 170 has a parallel floor 171 that is a fixed depth d1 from major front surface 140 for a distance l1 between proximate end 131 and a point p that is located a distance l2 from distal end 132. Between point p and distal end 132 recess 170 has a sloping floor 172 that slopes at a substantially constant rate from depth d1 at point p to a greater depth d2 at distal end 132. Referring now to FIG. 5, it can be seen that angle θ between sloping floor 172 and level floor 171 is approximately equal to the absolute value of $\tan^{-1}$ [(d2−d1)/l2].

Figure 7:
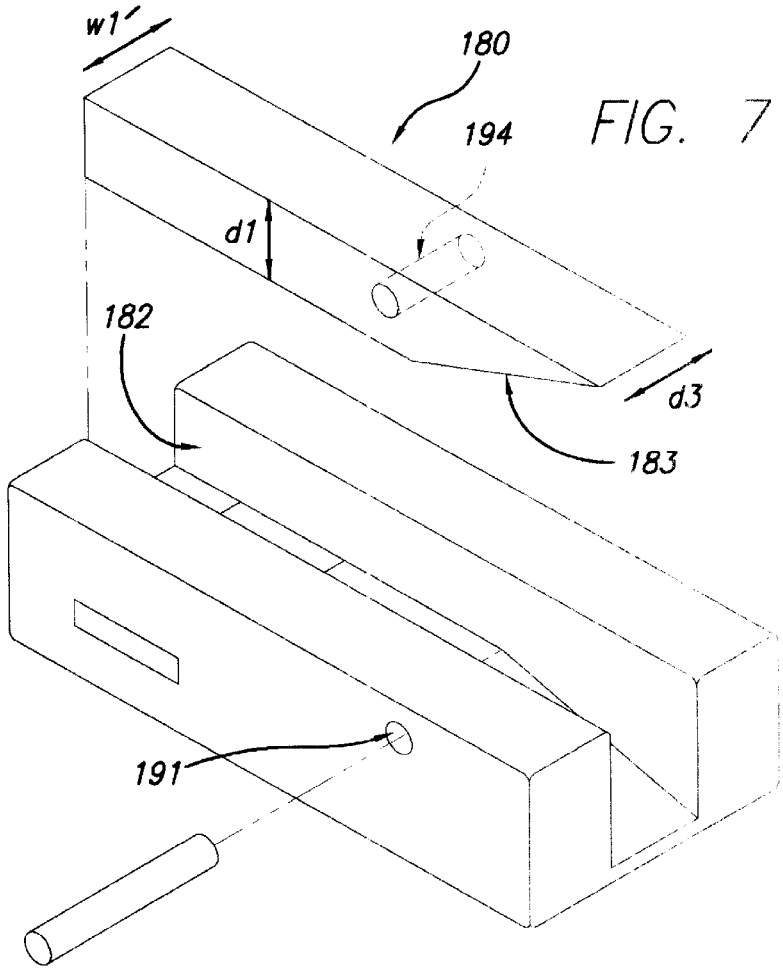
FIG. 7 is perspective view of a hanging apparatus 120 of the first embodiment with hanging member 180 shown above recess 170.

Referring now to FIG. 7, recess 170 is especially adapted to receive hanging member 180. Hanging member 180 may occupy recess 170 when not in use such that its major exterior surface 181 lies in the same plane as major front surface 140. This results in the front side of hanging apparatus 120 being substantially flat and smooth when there, and makes the hanging system compact and easy to store. Hanging member 180 preferably has a width w1' that is just slightly less than width w' of recess 170. In this way hanging member 180 will fit snugly within recess 170 such that there are forces of friction between the walls of recess 170 and hanging member 180 that prevent hanging member 180 from rotating about rotation axis 190 and extending out of recess 170 without a force first being exerted on hanging member 180 as described in greater detail below. Hanging member 180 also has an interior surface 182 that faces level floor 171 and is preferably at a depth of approximately d1 for an approximate distance l1 between proximate end 131 and point p that is located a distance approximately 12 from distal end 132.

Figure 8:
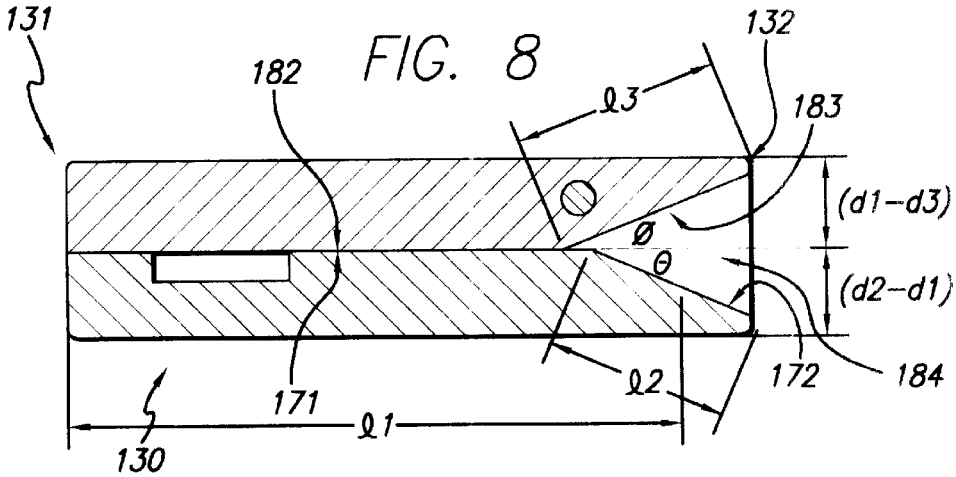
FIG. 8 is a side cross-section view of a hanging apparatus 120 of the first embodiment together with hanging member 180 to illustrate open angular space 184 between hanging member 180 and bracket 120.

Referring now to FIG. 8, between point p and distal end 132 hanging member 180 has an interior sloping surface 183 that slopes away from sloping floor 172 at a substantially constant rate from an approximate depth d1 at point p to more shallow depth d3 at distal end 132. Angle ϕ between major interior sloping surface 183 and major parallel interior surface 182 is approximately equal to the absolute value of $\tan^{-1}$ [(d1−d3)/l2]. This results in an open angular space 184 between distal end 132 and point p that is contained between oppositely facing interior sloping surface 183 of hanging member 180 and sloping floor 172 of recess 170, as well as the side walls of recess 170. The angle α between interior sloping surface 183 and sloping floor 172 is equal to ϕ+θ. Preferably ϕ is equal to θ such that α=2 θ.

Figure 6:
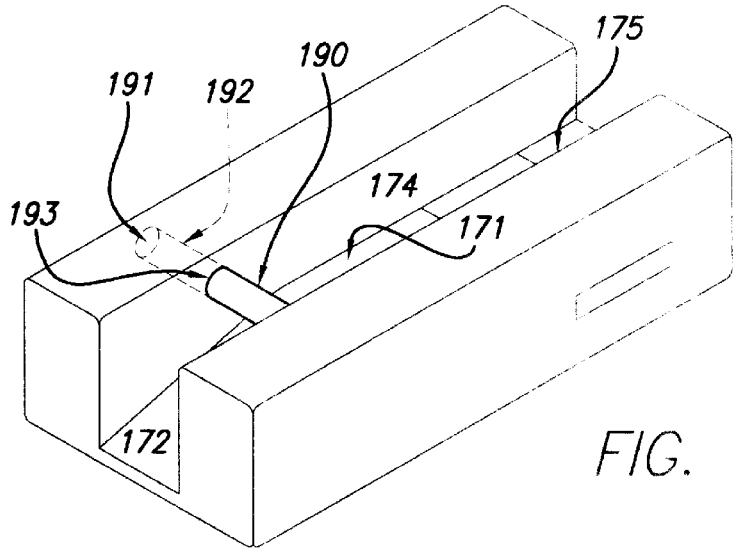
FIG. 6 is a perspective view of a hanging apparatus 120 of the first embodiment without hanging member 180 so as to illustrate rotation axis 190 about which hanging member 180 rotates.

Referring now to FIG. 6, rotation axis 190 traverses recess 170 at approximately point p at a depth d4 from major front surface 140 that preferably is approximately half of depth d1. Rotation axis 190 is inserted through an opening 191 in minor surface 160 and through a channel 192 that extends through to an opening 193 in a first side wall 174 of recess 170. From there it extends through channel 194 in hanging member 180 that is illustrated in FIG. 7. Rotation axis 190 is then fixedly attached to the second side wall 175 of recess 170. Hanging member 180 can thus rotate about rotation axis 190 when forces are applied to hanging member 180 as described below in greater detail.

Figure 9:
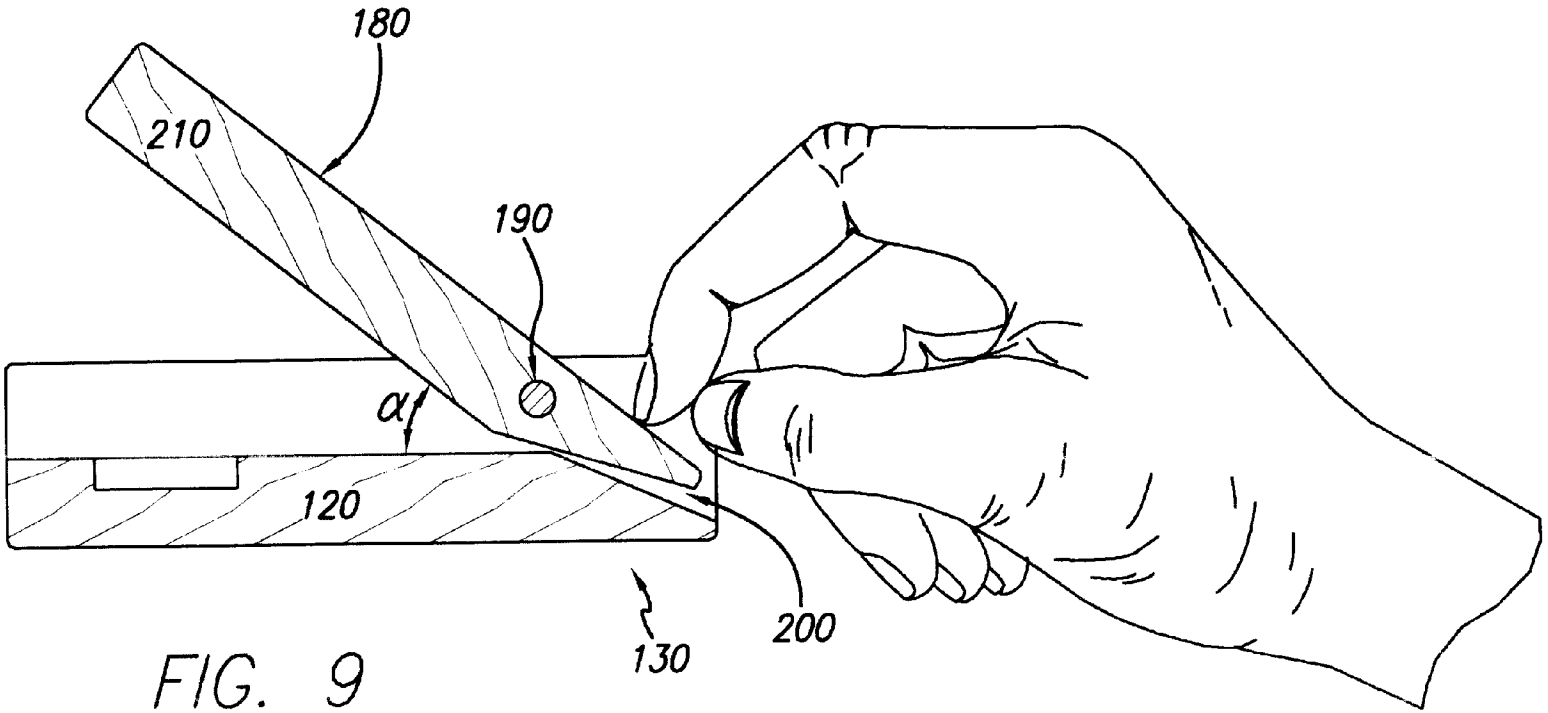
FIG. 9 is a side cross-section view illustration of hanging apparatus 120 of the first embodiment showing a user moving hanging member 180 from a recessed position within hanging apparatus 120 to a position extending out from hanging apparatus 120 at an angle.

Referring now to FIG. 9, proximate end 210 of hanging member 180 can be caused to extend out of and away from recess 170 by applying a force to distal end 200 of hanging member 180 that extends over open angular space 184. Applying a force to distal end 200 causes hanging member 180 to rotate about rotation axis 190 until major interior sloping surface 183 is in contact with sloping floor 172. At such point the portion of hanging member 180 between point p and proximate end 210 will be extending out and away from hanging apparatus 120 at an angle equal to α, as shown for example in FIG. 1 and FIG. 9. One or more items may then be hung from hanging member 180 as shown for example in FIG. 2. The weight of the items will be substantially transmitted through hanging member 180 against sloping floor 172 causing hanging apparatus 120 to be more firmly pressed against the tree trunk, or other object to which it is attached. This will help increase the frictional forces between hanging apparatus 120 and the tree trunk, which will help assist in supporting the item hanging. A force can later be applied to proximate end 210 that will cause hanging member 180 to rotate about rotation axis 190 until major parallel interior surface 182 is flush against parallel floor 171 of recess 170. At that point hanging member 180 will be contained within recess 170 such that major front surface 140 of hanging apparatus 120 is substantially flat and smooth so as to facilitate easy storage.

In a preferred embodiment hanging apparatus 120 and hanging member 180 may be constructed from a single block of wood. However, hanging apparatus 120 and hanging member 180 may also be made of a wide variety of other suitable materials, including but not limited to plastic that could be manufactured in mass quantity through an injection molding process. Rotation axis 190 is preferably a pin that may be made of wood or plastic, or some other material. But in a preferred embodiment rotation axis 190 is a pin made of a hard metal to ensure adequate strength to support loads that may be placed on it when hanging items.

Support member 100 may also be made of a wide variety of materials and configurations, including but not limited to rope or twine. However, in a preferred embodiment support member 100 is a belt constructed of sturdy nylon fabric and is generally flat for easier insertion through channel 150, as shown for example in FIG. 10. In a preferred embodiment buckle 110 is of such construction that the effective length of support member 100 may be adjusted before fastening so as to fit securely around the tree trunk, or other object, to which it is attached. In a preferred embodiment buckle 110 may also be easily removable from support member 100 and replaceable thereon, or of such a size, so as to facilitate the easy addition or subtraction of hanging apparatus 120 in the desired quantity.

While an embodiment of the hanging system disclosed herein utilizes a support member 100 in the form of a belt to temporarily secure hanging apparatus 120 to an object, it is not necessary that hanging apparatus 120 be secured to an object by a belt. With regards to application in an outdoor setting where it is desired to use the hanging system with a tree trunk, it is preferable to use a support member 100 in the form of a belt because the use of belt will not harm the tree or its protective bark. However, application of the present invention is not limited to use in outdoor settings, or for use with trees. The claimed hanging system has many other potential applications where it may be more appropriate to utilize another support member other than belt 100 as means of attachment to the object.

Figure 11:
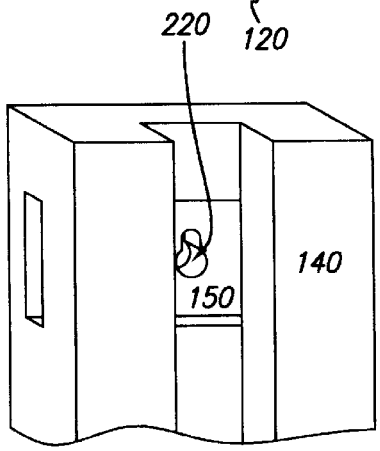
FIG. 11 is a perspective view of a second embodiment of hanging apparatus 120 that contains a channel 220 to facilitate attachment of hanging apparatus 120 to an object by a penetrating fastener.

For example, one other application of the present invention is in a retail store for hanging items. Referring to FIG. 11, many retail stores have objects to which the present invention could be attached by using a support member 100 in the form of a belt, such as for example a structural or decorative column in the store display area. Several support members 100 in the form of a belt could be secured at different heights along such a column, each belt containing a plurality of hanging apparatus 120 that could be used to hang items. Use of a belt may be appropriate if the hanging of such items is meant to be temporary. However, if such an arrangement is meant to be more permanent, than it may be desirable to permanently attach hanging apparatus 120 to the object (e.g. decorative or support column). Because such an object is not a living tree, hanging apparatus 120 could be permanently attached to such an object using a support member of more conventional means of attachment. Such conventional means of attachment could include, for example, the use of screws, nails, adhesive, or picture frame wire. For example, a channel 220 extending from level floor 171 through to major rear surface 130 could be used to attach hanging apparatus 120 to a peg board using a peg, a cork board using a thumb tack, or to a wall using a screw or nail. Preferably, as shown in FIG. 11, such channel 220 would be placed in channel 150 to so that the head of the peg, tack, screw or nail would not interfere with the ability of hanging member 180 to be recessed within hanging apparatus 120, and would also provide for the use of a belt if later the hanging apparatus were removed, and it was desirable to use a belt as the support member.

Figure 12:
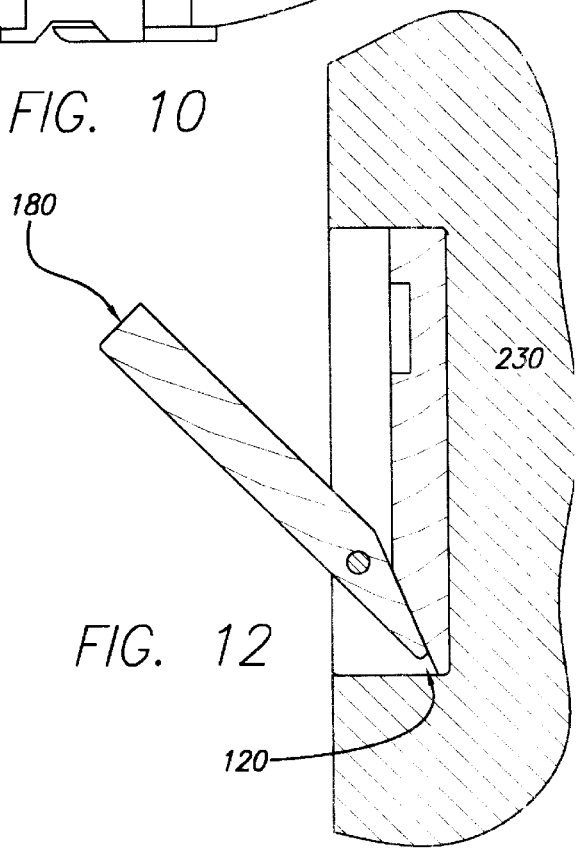
FIG. 12 is a side cross-section view of a hanging apparatus 120 of the first embodiment installed into a wall 230.

It may also be desirable to build hanging apparatus 120 directly into a structure. For example, as shown in FIG. 12, hanging apparatus 120 could be built into wall 230. When not in use hanging member 180 would be recessed into hanging apparatus 120 essentially becoming part of wall 230. Hanging apparatus 120 and hanging member 180 could be painted, or otherwise decorated, in such a fashion so as to effectively camouflage them so that it could not be readily discerned they were there. When needed, with a simple push hanging member 180 would extend from wall 230 for use in hanging an item.

It should also be noted that hanging apparatus 120 and hanging member 120 may be of various sizes and shapes depending upon the particular application. For example, as shown in FIG. 13, hanging member 180 may be provided with fingers 185 that extend out from hanging member 180. Fingers 185 may each be used to hang an item, helping to facilitate the hanging of multiple items from a single hanging member 180. Finger recesses 186 are formed in major front surface 140 to accommodate fingers 185 when hanging member 180 is recessed. Similarly, as shown in FIG. 14, hanging apparatus 120 may contain a plurality of hanging members 180.

In view of the above detailed description of preferred embodiments and modifications thereof, various other modifications will now become apparent to those skilled in the art. The claims below encompass the disclosed embodiments and all the reasonable modifications and variations without departing from the spirit and scope of the invention. What follows is a glossary of terms to be used as an aid in the understanding of the disclosure and claims.

Body—Any three dimensional object.

Recess—A cavity, opening or depression in a body.

Hanging Member—An object from which an item may be hung when it is extended outward from a body.

Rotatably Mounted—Mounted in such a way that it is free to rotate around a rotation axis.

Rotation Axis—Any structure that will allow an object to rotate or pivot about a point or an imaginary line. It includes, but is not limited to, a structure such as a pin.

Angular Space—Any volume of space on one side of a rotation axis that is at least partly bounded by a recess floor and an interior surface of a hanging member.

Interior Surface—Surface of a hanging member facing substantially towards the interior of a body.

Recess Floor—The surface of a cavity substantially facing towards an interior surface of a hanging member.

Channel—A passage between an opening in one surface to an opening in another surface.

Support Member—Any structure or object that may be used to secure a body to another object, including but not limited to a belt or penetrating fastener.

Belt—Any object whose length is greater than its width, and which may be wrapped around an object to secure a body to that object.

Penetrating Fastener—Any rigid object that may be used to attach a body to an object by penetrating into the object, such as for example a nail, screw, or tack.

Pin—Any substantially circular rigid object with a length greater than its diameter.

Finger—Any extension from a hanging member.

What is claimed is:

1. An apparatus for hanging items comprising:

a body with a recess defined at least in part by a first floor portion extending in substantially planar sloped manner from a second floor portion;

a hanging member with a first end and a second end, said hanging member defining between said first and second ends a first interior surface extending in substantially planar sloped manner from a second interior surface;

said hanging member rotatably mounted on a rotation axis within said recess;

said hanging member being capable of rotating about said rotation axis between a recessed position and a hanging position;

where at said recessed position said first end and said second end of said hanging member are both located within said recess, with there being a space between said first interior surface of said hanging member and said first floor portion of said recess; and where at said hanging position said second end of said hanging member extends out of said recess, and said first interior surface of said hanging member makes substantially planar contact with said recess first floor portion.

2. The apparatus of claim 1 wherein said body also contains a channel for a support member.

3. The apparatus of claim 2 wherein said support member is a belt.

4. The apparatus of claim 1 wherein said rotation axis is a pin.

5. The apparatus of claim 1 further comprising a finger extending from said hanging member.

6. A portable system for hanging items comprising:

a support member;

a body;

said body containing a channel for receiving said support member;

said body further containing a recess defined at least in part by a first floor portion extending in substantially planar sloped manner from a second floor portion;

a hanging member with a first end and a second end, said hanging member defining between said first and second ends a first interior surface extending in substantially planar sloped manner from a second interior surface;

said hanging member rotatably mounted on a rotation axis within said recess;

said hanging member being capable of rotating about said rotation axis between a recessed position and a hanging position;

where at said recessed position said first end and said second end of said hanging member are both located within said recess, with there being a space between said first interior surface of said hanging member and a said first floor portion of said recess; and, where at said hanging position said second end of said hanging member extends out of said recess, and said first interior surface of said hanging member makes substantially planar contact with said recess first floor portion.

7. The apparatus of claim 2 wherein said support member is a penetrating fastener.

8. An apparatus for hanging items comprising:

a body with a recess defined at least in part by a level floor portion and a sloped floor portion extending in substantially planar angled manner therefrom;

a hanging member being received in pivotally displaceable manner in said recess of said body for displacement between first and second positions relative thereto, said hanging member having first and second ends and defining a level interior surface and a sloped interior surface extending in substantially planar angled manner therefrom;

said level interior surface of said hanging member substantially opposing said level floor portion of said body to be in said first position disposed in substantially planar engagement with said level floor portion; and, said sloped interior surface of said hanging member substantially opposing said sloped floor portion of said body to be in said second position disposed in substantially planar engagement with said sloped floor portion;

both said first and second ends of said hanging member remaining within said recess in one of said first and second positions, and one of said first and second ends extending out of said recess in the other of said first and second positions.

* * * * *